US005205499A

United States Patent [19]

Gamblin

[11] Patent Number: 5,205,499

[45] **Date of Patent: * Apr. 27, 1993**

[54] PLANETARY GRINDING APPARATUS

[76] Inventor: Rodger L. Gamblin, 8 Springhouse Rd., Dayton, Ohio 45409

[ * ] Notice: The portion of the term of this patent subsequent to Jul. 9, 2008 has been disclaimed.

[21] Appl. No.: 725,275

[22] Filed: Jul. 3, 1991

Related U.S. Application Data

[63] Continuation-in-part of Ser. No. 427,815, Oct. 26, 1989, Pat. No. 5,029,760.

[51] Int. Cl.[5] ..... B02C 17/08

[52] U.S. Cl. ..... 241/137; 241/177; 241/178

[58] Field of Search ..... 241/137, 175, 176, 177, 241/178

[56] References Cited

U.S. PATENT DOCUMENTS

| | | | |
|---|---|---|---|
| 405,810 | 6/1889 | Wegmann . | |
| 458,662 | 9/1891 | Pendleton . | |
| 569,828 | 10/1896 | Herzfeld . | |
| 1,144,272 | 6/1915 | West . | |
| 1,951,823 | 3/1934 | Eppers . | |
| 2,209,344 | 7/1940 | Matthews . | |
| 2,387,095 | 10/1945 | Shideler . | |
| 2,874,911 | 2/1959 | Limb . | |
| 2,937,814 | 5/1960 | Joisel . | |
| 3,190,568 | 6/1965 | Freedman et al. . | |
| 3,311,310 | 3/1967 | Engels et al. | 241/153 |
| 3,513,604 | 5/1970 | Matsunaga . | |
| 3,529,780 | 9/1970 | Wilkinson, Jr. . | |
| 3,579,920 | 5/1971 | Heiberger | 241/177 X |
| 3,876,130 | 4/1975 | Block . | |
| 3,991,948 | 11/1976 | Schober et al. | 241/175 |
| 4,057,191 | 11/1977 | Ohno . | |
| 4,679,737 | 7/1987 | Romer | 241/246 X |
| 4,720,050 | 1/1988 | Eberhardt | 241/243 X |
| 5,029,760 | 7/1991 | Gamblin | 241/179 X |

FOREIGN PATENT DOCUMENTS

| | | |
|---|---|---|
| 1089428 | 11/1980 | Canada . |
| 260777 | 2/1912 | Fed. Rep. of Germany . |
| 1097790 | 1/1961 | Fed. Rep. of Germany . |
| 1088571 | 6/1952 | France . |
| 593777 | 10/1947 | United Kingdom . |

*Primary Examiner*—Mark Rosenbaum
*Assistant Examiner*—Frances Chin
*Attorney, Agent, or Firm*—Wood, Herron & Evans

[57] ABSTRACT

A planetary mill adapted for the continuous grinding of granulated material into fine powder is disclosed. A grinding chamber is provided that is continuously orbited in a planetary motion. As the tube undergoes its planetary motion it is caused to undergo a rotation about its own axis at the same rate and in an opposite sense to the planetary rotation. As a result the grinding chamber has no net rotation with respect to an external observer and can be connected to any number of external connections without the use of rotating seals provided the drive for the planetary rotation is external to the locus of points encompassed by the path of the connections as the system rotates. The ratio of the orbit radius of the planetary motion is 2.15 times that of the cylindrical tube so as to cause a cascade angle of about 45 degrees of mill mix and media in the orbiting tube which angle is independent of the rotation rate of the mill at reasonable speeds.

20 Claims, 2 Drawing Sheets

SECTION AA

SECTION BB

PLANETARY GRINDING APPARATUS

RELATED PREVIOUS INVENTION

This application is a continuation-in-part of my application Ser. No. 427,815 filed Oct. 26, 1989, now U.S. Pat. No. 5,029,760 issued Jul. 9, 1991 and entitled "Centrifugal Grinding and Mixing Apparatus".

BACKGROUND OF THE INVENTION

1. Field of the Invention

This invention relates to the field of grinding or comminution and dispersion and more particularly to the reduction of solid matter into fine particles. Generally only a single grinding tube is used for grinding.

The reduction of solid matter into fine powders is a major task of an industrial society. As an example Portland cement is made from finely ground limestone, clay or shale, sand, and coal or other fuel. The limestone, clay or shale, and sand are subjected to a thermal process in which the heat is derived from the coal and the results are clinkers of material that must again be ground to produce the cement. Gypsum, after calcining, must be ground to produce sheet rock and other such products.

The food industry grinds many products including wheat, corn, rice, spices, sugar, and even chocolate. Paints, inks, and so forth use ground pigments and in turn undergo a dispersion process to disperse the ground pigment in a suitable vehicle.

Ceramics are made from finely ground materials. Generally the better the grind the better the ceramic product. Metals are ground as part of powder metallurgy and to prepare metallic pigments.

2. Description of the Prior Art

One of the oldest and simplest methods of grinding materials to fine powders uses a ball mill that generally consists of a horizontal cylindrical chamber that may be of any size, but which can be up to eighteen feet in diameter by thirty or forty feet long.

For many applications the ball mill is about half full of steel or ceramic balls in addition to the material to be ground. The balls roll over one another and aid in the grinding process.

In cases where the material to be ground, such as a paint, consists of a fine pigment to be dispersed, the balls, usually called the grinding media, are essential to the process while in other cases such as the grinding of cement clinker the media is dispensed with. In this latter case the larger clinkers act as media for the smaller ones and a means is usually provided for extracting only the finer particles from the mill.

While the ball mill is effective and reliable it tends to be large and slow. The physical size of the mill tends to caused it to be high in capital cost for the amount of work done.

There is much art having to do with overcoming the deficiencies of the ball mill. Alternative approaches to the task of grinding include mills wherein a material is stirred with media by means of mandrels or where material is subjected to very high shear rates by high speed blades or by being forced through narrow gaps between rapidly moving surfaces. Such devices are most useful for dispersion while a ball mill both grinds and disperses. Mills intended for rather course grinding achieve a result by subjecting the material to be ground to a crushing action with hammers or gear like teeth.

In order to obtain the benefits of a ball mill while overcoming its deficiencies considerable prior art has addressed planetary mills in which the grinding chamber is orbited about an axis parallel to the axis of the grinding chamber. In such art the planetary motion imparts a centrifugal force that aids the action in the grinding chamber.

For example, Wegmann in U.S. Pat. No. 405,810 discloses an orbiting mill driven by planetary gears so as to produce centrifugal forces to aid in the grinding. While well adapted to a batch process the Wegmann device precludes direct attachment of input and output ducts.

Another form of planetary mill is disclosed in Pendleton, U.S. Pat. No. 458,662. Due to the necessary supporting framework, the feed to the mill is required to pass through the machine axis by means of a rotating seal. A similar rotating seal feed is required by Hertzfeld in U.S. Pat. No. 569,828 which describes vertically oriented orbiting grinding chambers.

West in U.S. Pat. No. 1,144,272 describes a multiple grinding tube centrifugal mill having a planetary gear drive. Access to the grinding tubes is provided by doors on the side of the tubes thus permitting only batch operating processes. Eppers in U.S. Pat. No. 1,951,823, like Pendleton and Hertzfeld above, discloses an axial feed with rotating seals for a planetary mill.

Matthews in U.S. Pat. No. 2,209,344 discloses a planetary rock crusher employing bars as the grinding media. Ore is fed into the mill at its axis and then circulated through the several planetary grinding chambers. Shideler et al. in U.S. Pat. No. 2,387,095 discloses a multiple tube planetary polishing or abrading machine equipped with a fixed eccentric to maintain the tubes in a fixed orientation relative to ground. The tubes are individually closed with stoppers to permit only batch operation.

Limb in U.S. Pat. No. 2,874,911 discloses a planetary ball mill wherein the grinding chamber rotates more rapidly about its own axis than it does about its orbital axis, thereby limiting its operation to a batch process.

Joisel in U.S. Pat. No. 2,937,814 discloses a planetary ball mill having two forms. The first form describes a discontinuous or batch process while the second form shows a continuous grinding process using rotary seals at the inlet and outlet. Separate motors are provided to drive the mixing chambers and to provide the orbital motion so that the relative speeds may be varied.

Matsunga et al. in U.S. Pat. No. 3,513,604 discloses a planetary polishing machine having a variable ratio of the orbital rotation rate to grinding chamber rotational rate so as to necessitate a batch process. Wilkinson, Jr. in U.S. Pat. No. 3,529,780 discloses a continuously fed planetary grinding mill having an intermittent discharge into a curved trough.

Bloch in U.S. Pat. No. 3,876,160 describes a centrifugal mill wherein the grinding chambers and orbital motion are separately controlled. Alternatively the grinding chamber axis may be parallel to the orbital axis, perpendicular to the orbital axis or varied respective to the radius of the planetary movement. However, in all cases a batch operation is contemplated.

Freedman et al. in U.S. Pat. No. 3,190,568 discloses a cell disintegrating apparatus for batch or continuous operation in which the disintegrating tube is rapidly oscillated in a direction perpendicular to its axis to shake and abrade cellular material. Ohno in U.S. Pat. No. 4,057,191 discloses a grinding mill having a grinding tube with one end mounted in a spherical bearing while the other end is moved in a circular path by a rotating crank so as to make a hybrid form of planetary mill.

German patent 260,777 (1913) discloses a planetary ball mill having a toroid-shaped grinding chamber wherein the grinding chamber radius is significantly greater than the planetary or orbital motion radius. Both the feed and discharge are gravity controlled.

German patent 1,097,790 (1961) discloses a planetary crushing mill for granulated solid material suspended in a liquid wherein the rotation of the grinding chamber is independent of the planetary or orbital motion thus requiring rotating seals at the inlet and outlet of the grinding chamber.

British patent 593,777 (1947) to Benham discloses a planetary grinding mill in which a spheroidal grinding chamber is orbited about a vertical axis and simultaneously oscillated about its own axis. The spheroidal grinding chamber is supported from one end in a pivoted bearing so that variations in the centrifugal force due to the quantity of material being ground can be used to control the feed rate to the grinding chamber. Material exits the grinding chamber through a mesh screen so as to provide control over the size of grind. In order to make the classification scheme work properly it is essential to the Benham patent that the grinding chamber have a vertical axis.

Canadian patent 1,089,428 (1980) discloses a planetary grinding mill driven by a pair of eccentrics such that the orbiting radius is small compared with the grinding chamber radius so as to provide "a continuous operation in the sub critical range at a high grinding rate per unit of volume of the grinding drum . . . " (page 1, 11. 22–23).

French patent 1,088,571 (1955) discloses a planetary grinding mill driven by pairs of counterbalanced cranks connected by a pair of crossarms to which one or more grinding chambers are affixed.

SUMMARY OF THE INVENTION

In accordance with the present invention a simplified planetary mill is provided that has a single grinding tube rotatably mounted in a grinding tube cage with an adjustable counterweight. Dynamic balance is maintained by control of the charge to the mill or alternatively by adjusting the mass of the counterbalance or its distance from the axis of planetary motion. The grinding tube is restrained so that it has no net rotation with respect to an external observer and thus can be continuously fed and discharged by flexible connections that involve no rotating seals.

In one preferred embodiment the grinding tube consists of a single continuous tube rotatably mounted in the grinding tube cage and connected at each end rigidly to fixed connectors. Rotation of the grinding tube is prevented by the tube itself having resistance to being twisted, that is, resistance to tangential forces perpendicular to the axis of the tube and in the tube wall. This resistance coupled with the rigid mounting at each end prevents rotation of the grinding tube.

This preferred embodiment of a planetary mill is especially useful in the grinding of hard heavy materials such as Portland cement clinker. A unit for this purpose has a single flexible tube of uniform cross section for a grinding tube. Material is loaded into the tube from either end and rapidly falls down the centrifugal force field and is held in the vicinity of the grinding tube cage where it is ground. Air is blown through the grinding tube but only the finer dust can be entrained by the air against the centrifugal force field in the grinding tube. Such dust is blown out of the unit where it is collected by conventional means, such as, for example, bag filters.

This particular realization of a planetary mill can have the flexible grinding tube lined with a hard rigid material in the region enclosed by the grinding tube cage and can have a rigid physically strong support tube encompassing the flexible tube in this same region. Such details are used as necessary depending upon the type material to be ground and the physical size of and rate of rotation of the mill.

A second preferred embodiment of the planetary mill takes advantage of the fact that only one end of the grinding tube need be used for continuous feed and withdrawal. The other end is thus available for a drive shaft that can act to drive the grinding tube cage. A simple chain, timing belt, or belt drive can then be used to restrain the rotation of the grinding tube so that an especially simple implementation is achieved for a device most suited for the grinding and dispersion of paints, inks, pigments, food grains and other such products.

In all embodiments a counter weight is provided so as to maintain balance of the machine. In operation the charge in the grinding tube can be controlled to maintain dynamic rotational balance. The weight or positioning of the counter weight can also be controlled and such control is especially useful to grossly balance the mill to accommodate different media and types of material to be ground.

The invention of this application shares the features of my previous application with regard to solving some of the problems associated with prior art. Present ball mills tend to be massive, costly and slow for the amount of material ground. Stirred mills tend to suffer from an inability to grind material of a size comparable to the size of the media in the mill, problems of high starting torque, media separation (from the material being ground), cost, and wear. High shear mills tend to suffer from problems of rotating seals and especially from problems of wear and maintenance. Mills that crush or hammer are capable only of relatively coarse grinding. All these problems tend to be relieved with the invention of this application.

This invention, as opposed to the invention of my previous application, achieves a special elegance of design by considering devices wit only one grinding tube. Two configurations aimed at somewhat different application areas are of very low cost compared to competitive equipment and solve problems of wear and maintenance, size, and speed of grind. Though this configurational advantage would seem to be obtained at the cost of maintaining dynamic balance, the latter in practice has turned out not to be a major problem at least for a major class of applications since the type charge in the mill usually does not vary from day to day and a given type of charge can be accurately controlled by manipulating the rate of feed of material to be milled, the rate of withdrawal, or both.

DESCRIPTION OF THE DRAWINGS

Further objects and advantages of the invention will become apparent from the following detailed description of the invention and the accompanying drawings in which.

DETAILED DESCRIPTION OF THE INVENTION

Figure 1:
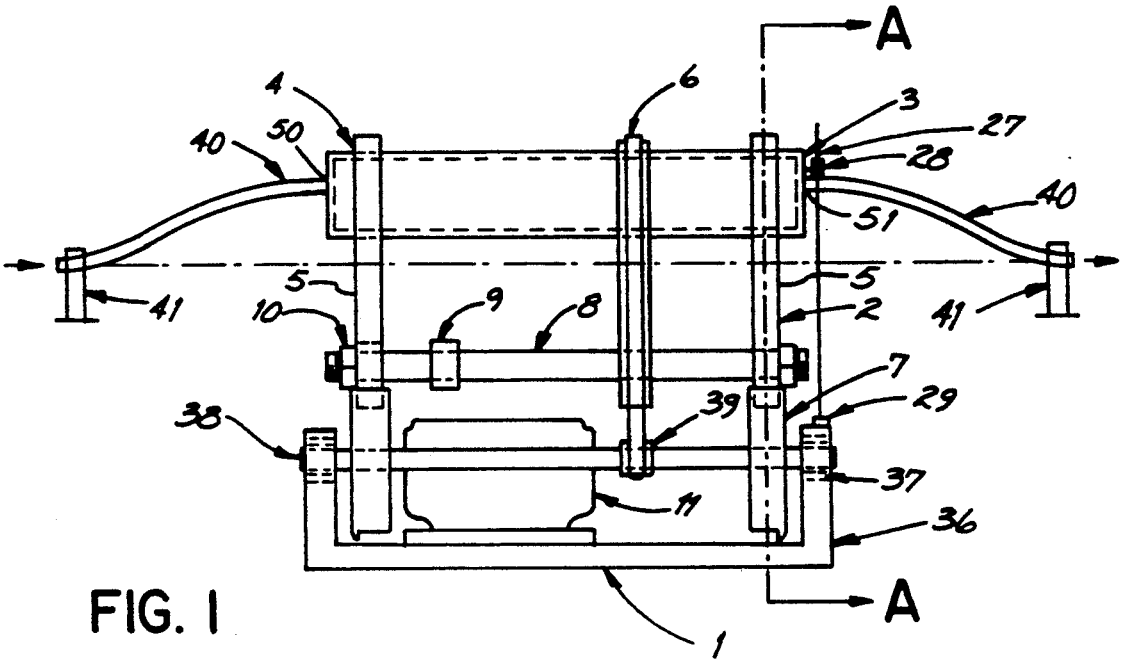
FIG. 1 is a side view of a single tube planetary mill. In all configurations of mill discussed in this invention the tube containing the material to be ground is called the grinding tube (or the cylindrical grinding tube) and the mechanism that carries the grinding tube in its planetary motion is called the grinding tube cage.

It has long been known that grinding of coarse material into a fine powder and homogeneous dispersion of the powdered particles can be obtained in a ball mill if the ball mill is operated for a sufficiently long time, e.g., 24 hours. Grinding results from the cascading of the balls against one another, the wall of the mill, and the material to be ground.

Cascading of the balls results from the fact that the rotation of the cylindrical grinding chamber and the viscosity of the material to be ground tend to carry the balls up the walls of the grinding chamber until the force of gravity causes the balls and the material to be ground to flow. There tends to be an optimum rotation rate for a mill of a given diameter. At high rotational speeds the centrifugal force developed in a mill overcomes the gravitational force so that the media and material to be ground become pinned to the wall of the mill over a full cycle so that neither grinding nor cascading occurs.

If the rotational speed of a ball mill is too slow, on the other hand, the balls and material to be ground do not properly climb the mill walls and move over one another and the resulting gentle action and sliding motion impedes the proper action of the mill. It has been found that optimum grinding occurs when the mill mix (the combination of balls and material to be ground) achieves an approximate angle of 45 degrees with respect to the horizontal. This condition arises when the centrifugal force associated with an element of mill base near the wall is slightly less than one half the force of gravity. This value is achieved at a fixed rotational rate for a given diameter of mill so that, as noted above, a given ball mill operates in an optimum manner at a fixed rotational speed.

For a given mill mix density a mill of a particular diameter and length operating at an optimum rotation rate consumes a nearly fixed amount of power. The power consumed determines the capacity for grinding of the mill for a given material to be ground and this power is fixed by the size of the mill. All of these considerations apply because the force of gravity is a particular number on the surface of the earth which, of course, is the only place presently relevant for ball milling. The fact that the capacity of a ball mill can only be changed in a significant way by changing the size of a mill is the source of the problem, referred to above, of ball mills being slow and costly for a given grinding capacity.

Since it is the value of gravity that fixes the basic design parameters of a ball mill with regard to size and grinding capacity, an alternative to this situation is provided by a planetary mill. In the case of a planetary mill the centrifugal force associated with the planetary rotation replaces the force of gravity and can be selected by the designer of the mill to be almost any desired value. In the systems considered by this invention the forces corresponding to the centrifugal forces of a conventional ball mill are proportional to the forces that correspond to the gravitational forces and can be selected to be at an optimum for proper cascading in the mill independently of the rotation speed of the mill. These considerations permit the design of a planetary mill that is physically small and yet capable of great output. These matters can be analyzed in a quantitative manner.

If the grinding chamber is orbited about an axis parallel to its own axis and rotated about it own axis in the opposite direction at a rate of one rotation per orbit, the grinding chamber will maintain a fixed orientation with respect to the machine base, but the grinding media will be affected as if it were in a gravitational field of a magnitude of $w^2R_1$ and where $R_1$ is the orbiting radius of the grinding tube axis and w is the angular speed in radians per second.

In the case of a grinding chamber orbiting as above the ratio of the apparent centrifugal force in the chamber (that which corresponds to the centrifugal force in a conventional ball mill) to the apparent gravitational force is given by the ratio of $R_2$ to $R_1$ where $R_2$ is the radius of the grinding tube. This result is independent of the speed of rotation of the mill. This independence of the rotation speed is especially significant with regard to a given mills ability to operate over a range of power levels.

Since optimum operation of a ball mill occurs when the cascade angle is about 45 degrees and such an angle is implied when the ratio of the centrifugal force associated with rotation is 1/2.15 that of the apparent gravitational force, $R_1/R_2$ is selected as 2.15. Just as the efficiency of a ball is nearly optimum at speeds near its optimum so can the ratio of radii be varied somewhat without significant loss. The ratio of radii can thus vary from about 1.2 to one to about 4.0 to one with a preferred value being 2.15 to one.

The grinding power (P) expended in planetary mills of this invention is given by the formula:

$$P=3.057\times10^{-8}dlR_1R_2^3\,(rpm)^3$$

where:

P = grinding power in horsepower
d = mill base density in lbs/ft$^3$
l = length of the grinding tube in feet
$R_1$ = orbiting radius in feet
$R_2$ = grinding tube radius in feet.

When the optimum ratio of about 2.15 is employed for the ratio of the orbiting radius to the radius of the grinding tube the formula reduces to:

$$P=3.083\times10^{-9}dlR_1^4(rpm)^3$$

The grinding power of a particular such planetary mill having a single 5.6 inch diameter grinding tube and a length of two feet orbiting at 430 rpm on an orbital diameter of one foot and employing 1/16 inch diameter balls is about the same as that of a conventional ball mill 4 feet in diameter and 8 feet long rotated at 21.5 rpm and employing ⅜ inch diameter balls.

The enhancement of the effective force of gravity by the centrifugal forces in a planetary mill as opposed to a ball mill as illustrated by these examples leads to a much smaller chamber for the amount of power consumed by the mill. The rate of grind is enhanced in a similar manner so that in the smaller chamber only a few seconds are required to get a grind. Without continuous feed the planetary feature can lead to the situation where a small amount of mill mix is ground in a short time leading to the need to start and stop the mill every few seconds for discharge and recharge. Continuous feed is thus seen as an essential element in a practical planetary mill.

The invention of this application uses a grinding tube that has no net rotation with respect to a fixed observer. This particular feature permits one or more connections between fixed tubes or connectors external to the device and fixed tubes or connectors rigidly mounted on the face of the grinding tube without the need for rotating seals. It is worth noting that if there is net rotation of the grinding tube with respect to an external connection, not only must a rotating seal be incorporated with a connection between the grinding tube and external connector, but also only one connection may be made to the grinding tube face. Otherwise multiple connections will twist up with one another. This feature is of significance since in a practical milling device cooling water, temperature sensors and the like are generally desired.

Figure 2:
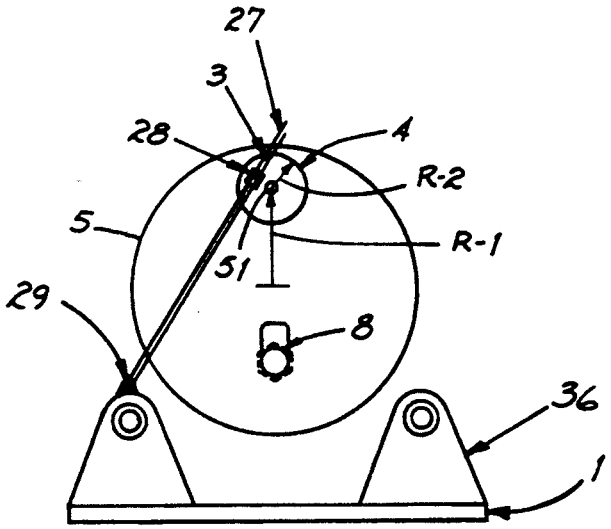
FIG. 2 is a cross sectional view of the configuration shown in FIG. 1.

Reference is now made to figures 1 and 2 which represent an embodiment of a single chamber planetary mill. The mill comprises a base 1 which carries four pedestals 36. A bearing 37 is mounted in each pedestal and two axles 38 are rotatably mounted each in a pair of bearings so as to have two spaced, parallel, rotatably mounted, even axles. Each axle carries two flanged support wheels 7.

A rotatable drum assembly 2 is positioned to engage the flanged support wheels 7. A belt 6 surrounds the drum assembly and also surrounds a pulley 39 which in turn is mounted on the shaft of motor 11. When the motor is activated by suitable electrical circuitry (not shown) the drum assembly, which will hereafter be called "the grinding tube cage", rotates about its axis.

A grinding tube 3 is rotatably mounted in aperture plates 5, 5 of the grinding tube cage by means of bearings 4. The grinding tube has an internal radius of $R_2$ and is mounted in the grinding tube cage so as to undergo planetary rotation with the radius of planetary motion of its axis being $R_1$ as the grinding tube cage rotates. As described above the preferred ratio of $R_1/R_2$ is 2.15 to one.

To counterbalance the rotational forces created by the grinding tube motion a counter weight 8 is mounted in the grinding tube cage by means of fasteners 10. Additional weights 9 may be used to vary the weight of the counterweight 8.

The grinding tube 3 is restrained from any net rotation by means of tie bar 27 which at one end is rotatably mounted to the face of the grinding tube by means of fastener 28. Fastener 28 has an opening that receives tie rod 27 and permits the tie rod to slide in this opening so that the tie rod 27 can both rotate with respect to the grinding tube and can also slidably extend with respect to this tube. At its other end the tie rod is rotatably mounted to a fixed attachment on one of the pedestals 36. As the grinding tube cage rotates the tie rod maintains the orientation of the grinding tube so that this orientation in space rocks about a fixed direction.

Tubes 40 are used to connect feed and discharge port 50, 51 of the grinding tube cage to the external world and these tubes may be rigidly attached to restraints 41. It can be seen that except for the rocking associated with the tie rod 27, the external tubes do not twist up as rotation of the grinding tube cage occurs. It can also be seen that more external connections may be made between the external restraints and the grinding tube cage with no problems arising from the connections twisting up with each other since they behave much like a bundle of ropes being skipped together.

Figure 3:
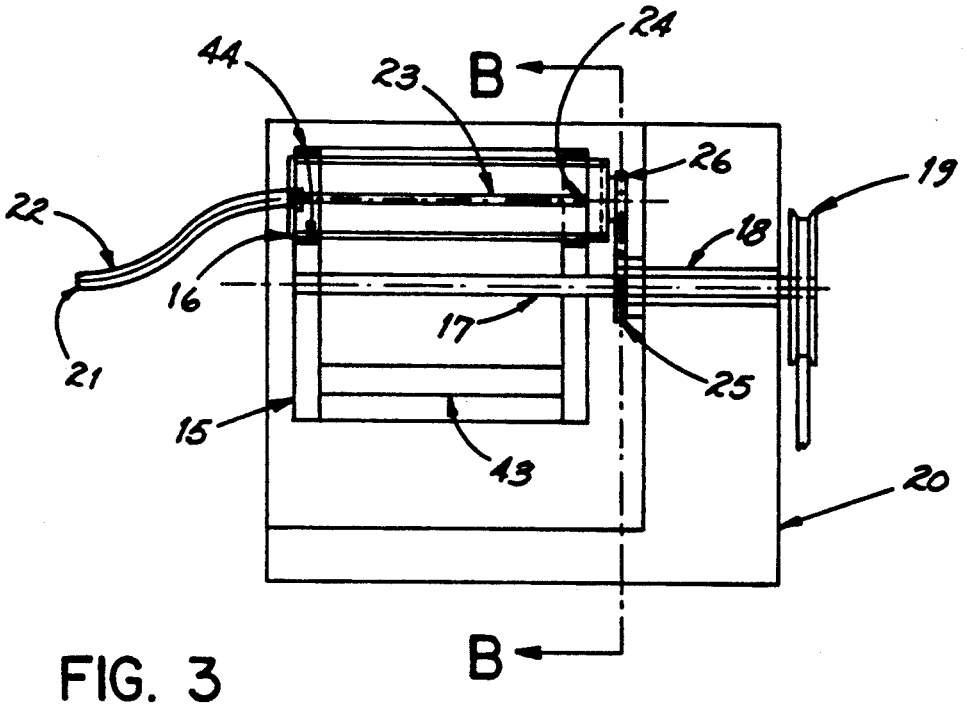
FIG. 3 is a side view of a preferred planetary mill configuration wherein advantage is taken of the fact that access to the mill from external connectors need only take place from one end. The other end is used to drive the mill and to restrain the rotation of the grinding tube.
Figure 4:
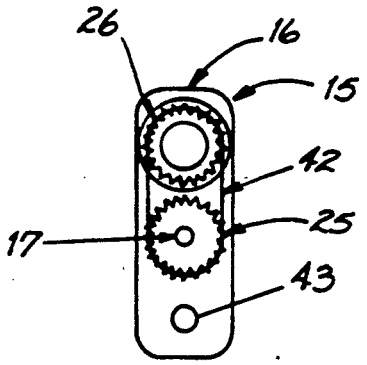
FIG. 4 is a cross section of the configuration shown in FIG. 3.

FIGS. 3 and 4 show an implementation of a mill that offers considerable benefit for applications such as manufacturing paints or inks. A shaft 17 is rotatably mounted by means of bearings 18 in base 20. A pulley 19 is provided at the end of the shaft remote from grinding tube cage 15. Pulley 19 can be driven by a motor or other rotary power source which is not shown.

Attached to the base so that it is not free to rotate is chain sprocket 25 which is concentric to and surrounds shaft 17. Shaft 17 is free to rotate with respect to sprocket 25. Shaft 17 extends from the front of the base 20 and grinding tube cage 15 is rigidly mounted upon shaft 17. Grinding tube 16 is rotatably mounted in grinding tube cage 15 by means of bearings 44. At the end of grinding tube 16 nearest base 20 chain sprocket 26 which is the same diameter as chain sprocket 25 is mounted rigidly to grinding tube 16. Chain 42 connects sprocket 25 with sprocket 26.

As the grinding tube cage rotates it can be seen that chain 42 wraps around sprocket 25 and in so doing rotates sprocket 26 so that the grinding tube has no net rotation with respect to an external observer. To say the same thing another way, a point on the grinding initially on top stays on top at all times as the grinding tube cage rotates.

Counterbalance 43 acts as a counterweight to the grinding tube as the grinding tube cage rotates.

Tube 21 is rigidly attached between a fixed external connector, not shown, and a fitting at the end of grinding tube 16 remote from sprocket 26 and acts as an input to the mill. Tube 22 is rigidly connected to an external connector, not shown, and to a fitting on the face of grinding tube 16 which in turn may be connected to tube 23 which extends internally along the axis of the grinding tube and which is open by means of lateral holes at the end of the grinding tube adjacent to sprocket 26. Tube 23 can readily be supported by means of a depression in the wall of the end of grinding tube 16. By this means material may enter the mill at one end of the grinding tube, be milled as the mill rotates and be picked up for exit from the opposite end of the mill. All connections to the grinding tube are from one end.

As shown in FIG. 4 the grinding tube cage need not be circular in cross section though it might be so. Elements of a working design such as safety covers, the motive force, a base extension to bring the machine to a convenient height, details of the grinding tube entrance and exit have not been shown since these items are matters of detailed design and contribute little to an understanding of the principles of the device.

Figure 5:
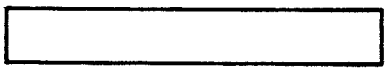
FIG. 5 shows a second preferred embodiment wherein the grinding tube consists of a single continuous tube threaded through the grinding tube cage wherein it is rotatably mounted. Proper orientation of the grinding tube is maintained by the stiffness of the walls of the grinding tube which are designed to resist any twist or torque in a plane perpendicular to the tubes axis. This configuration is especially simple of design being similar to a hollow skip rope.
Figure 5:
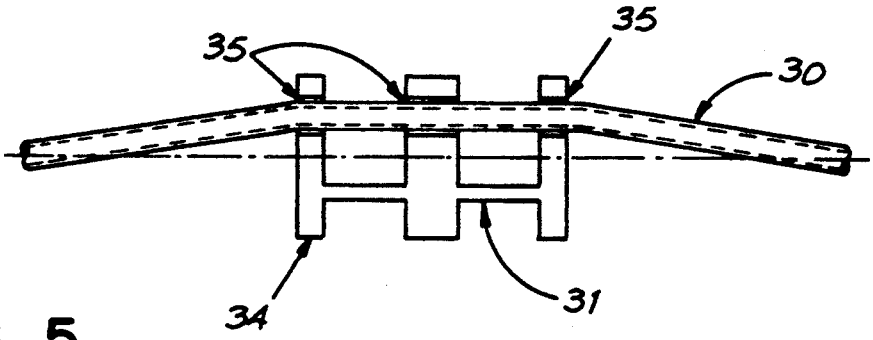

FIG. 5 shows an implementation of this invention that seems to be especially useful for grinding materials such as cement clinker that act as their own media. A rotatably mounted grinding tube cage 34 is provided. A cylindrical grinding tube 30 is threaded through rotatable mountings 35 in the cylindrical grinding tube cage and a counterbalance 31 provided to achieve dynamic balance.

In operation the cylindrical grinding tube cage is rotated and the grinding tube undergoes a motion similar to that of a skip rope. The cylindrical grinding tube is prevented from twisting about it's own axis by the stiffness of the grinding tube walls which are designed to be rigid enough to resist any tendency to twist as the grinding tube cage rotates.

Though the cylindrical grinding tube is flexible its inner surface can easily be modified by the insertion of an inner sleeve or liner that can act as a wear surface for the mix of media and material to be ground inside the cylindrical grinding tube grinding tube. Similarly a lining to receive the cylindrical grinding tube may be included between the bearing mounts in the grinding tube cage and the cylindrical grinding tube to provide support for this tube. The liner and support tube present no substantial chance in the operation of the planetary grinding mill provided they do not extend substantially in a longitudinal fashion beyond the ends of the grinding tube cage. Such liners and supports may be useful in the grinding of certain materials in mills of certain sizes and speed ranges.

For sake of clarity, details of the mounting of the grinding tube cage are not shown, but could be similar to the arrangement shown in FIGS. 1 and 2. Similarly a drive mechanism is not shown though support 33 provides for a drive belt similar to the one shown in FIGS. 1 and 2.

The configuration of mill shown in FIGS. 3 and 4 compare to devices currently sold for application in the paint and ink industries. Such devices are variously called sand, bead, or shot mills depending upon what media is used with the mill. These mills are either horizontal or vertical. With a vertical mill the media for grinding is contained between a heavy fixed cylinder and a rotatable mandrel. The material to be ground is percolated up through the material to be ground as the mandrel is rotated and overflows the top after grinding.

It can readily be seen that when a vertical shot or bead mill stops, say for over a weekend or other such, all the media settles to the bottom and tends to hold the mill mandrel in place when an attempt is made to restart the mill. This type of mill thus has a problem with starting torque.

The vertical shot or bean mill also suffers from wear and media separation from the material to be ground, but is fairly easy to seal, has reasonable efficiency and is not terribly expensive to manufacture. Because of the torque problems and because of problems with media separation, horizontal mills have come into vogue. With this type mill a horizontal mandrel and grinding chamber is used that alleviates the problems of starting torque, but media separation from the material to be ground is achieved by means of very high tolerance, very hard containment rings. The cost of the mill is thus high. Even with high tolerance fittings, difficult grinding jobs present difficulties of media and mill base separation.

This invention achieves easy separation of media from material to be ground because the high effective gravitational field due to the centrifugal forces increases the absolute force tending to separate the media from the mill mix. The media are found at the bottom of an inertial force field that acts to retain anything dense at the bottom. Because of these factors this invention does not require narrow tolerance parts of exotic materials nor for that matter any high tolerance parts.

As seen above the equation for the power consumed by the mill shows a cubic dependence on the rotational rate. At low speed the mill consumes little power and since the speed is low during start up there is little starting torque. Mills designed in accordance with the principles of this invention therefore combine the desirable character of low starting torque of a horizontal shot or bead mill with the low cost and ease of design of a vertical shot or bead mill.

In summary this invention overcomes some of the disadvantages of prior art having to do with planetary mills by providing for continuous feed and withdrawal of material from the mill. Disadvantages associated with the size of ball mills is overcome because of the enhanced forces of this invention. Problems of high starting torque of vertical sand or shot mills are overcome since the mill does not begin to exert much grinding action until the mill is up to speed. No extreme tolerance or exotic parts are required by the mill as opposed to horizontal shot or bead mills, and media separation is enhanced over all current mills because of the centrifugal force field. Wear surfaces in the mill are either the media itself or replaceable, inexpensive grinding tube chamber liners thus offering advantages over high shear mills.

What is claimed is:

1. A planetary grinding mill comprising a base, a rotatable drum assembly supported on said base for rotation about an axis, said drum assembly including a cylindrical grinding tube having an axis parallel to and offset from said axis of said rotatable drum assembly, said cylindrical grinding tube mounted in said drum assembly for rotation relative to said rotatable drum assembly, means for limiting rotation of said cylindrical grinding tube with respect to said base while said drum assembly is being rotated, and driving means supported by said base and drivingly interconnected with said rotatable drum assembly to rotate the latter.

2. A planetary grinding mill as described in claim 1 wherein said means for limiting rotation of said cylindrical grinding tube comprises a bar affixed at a first end to said cylindrical grinding tube by means of a pivotally mounted bushing that permits rotation relative to and sliding with respect to said cylindrical grinding tube and wherein the second end of said bar is pivotally connected to a bushing on said base.

3. A planetary grinding mill as described in claim 2 wherein said drum assembly comprises a pair of apertured plates and said base also comprises a plurality of support wheels disposed to receive and support said apertured plates.

4. A planetary grinding mill as described in claim 2 in which said cylindrical grinding tube is provided with at least one feed port and one discharge port which can be attached to feed and discharge tubes by non rotating seals.

5. A planetary grinding mill as described in claim 1 wherein the orbiting radius of said cylindrical grinding tube is in the range of about 1.2 to about 4.0 times the radius of said cylindrical grinding tube.

6. A planetary grinding mill as described in claim 5 wherein said drum assembly comprises a pair of apertured plates and said base also comprises a plurality of support wheels disposed to receive and support said apertured plates.

7. A planetary grinding mill as described in claim 6 wherein said driving means is an electric motor pivotally supported on said base and interconnected with said drum assembly by at least one belt.

8. A planetary grinding mill as described in claim 6 in which said cylindrical grinding tube is provided with at least one feed port and one discharge port which can be attached to feed and discharge tubes by non rotating seals.

9. A planetary grinding mill as described in claim 5 in which said cylindrical grinding tube is provided with at least one feed port and one discharge port which can be attached to feed and discharge tubes by non rotating seals.

10. A planetary grinding mill as described in claim 1 in which said cylindrical grinding tube is provided with at least one feed port and one discharge port which can be attached to feed and discharge tubes by non rotating seals.

11. A planetary grinding mill as described in claim 1 wherein said drum assembly is supported on said base by means of an axle rotatably mounted in said base and cantilevered from said base so as to axially support said drum assembly.

12. A planetary grinding mill as described in claim 11 wherein said cylindrical grinding tube is provided with at least one feed and one discharge port attached at the end of said cylindrical grinding tube remote from said axle rotary mounting which said ports can be attached to feed and discharge tubes by non rotating seals.

13. A planetary grinding mill according to claim 11 wherein said means for limiting rotation of said cylindrical grinding tube is provided by an assembly comprising a driving ring fixedly attached to said cylindrical grinding tube, a driving ring fixedly attached to said base and a flexible member drivingly mounted on both of said driving rings so that their rotations are in one to one correspondence.

14. A planetary grinding mill according to claim 13 wherein the orbiting radius of said cylindrical grinding tube is in the range of about 1.2 to 4.0 times the radius of said cylindrical grinding tube.

15. A planetary grinding mill according to claim 13 wherein said cylindrical grinding tube is provided with at least one feed and one discharge port attached at the end of said cylindrical grinding tube remote from said driving rings which said ports can be attached to feed and discharge tubes by non rotating seals.

16. A planetary grinding mill comprising a base, a rotatable drum assembly supported on said base for rotation about a horizontal axis, rotatable bearing rings with an axes parallel to and offset from said rotating drums horizontal axis, with said rotatable bearing rings mounted in line in said rotatable drum assembly, a flexible grinding tube threaded through said bearing rings and extending substantially beyond at least one end of said rotatable drum assembly which flexible grinding tube is fixedly connected to at least one fixed external connector and which flexible grinding tube is rigid against twisting so as to prevent substantial twisting of said flexible grinding tube about its own axis.

17. A planetary grinding mill according to claim 16 wherein the radius of the planetary motion of the axis rotation of said rotatable bearing rings is in the range of 1.2 to 4.0 times the radius of the flexible grinding tube in at least the region of flexible grinding tube enclosed by said rotatable drum assembly.

18. A planetary grinding mill according to claim 16 wherein said flexible grinding tube is substantially of uniform diameter.

19. A planetary grinding mill according to claim 16 wherein said flexible grinding tube has an inner liner of essentially non flexible material in the region of said flexible grinding tube enclosed by said rotatable drum assembly.

20. A planetary mill according to claim 16 or 19 wherein a support tube is mounted in said rotatable rings and said flexible grinding tube is threaded through said support tube.

* * * * *